US011364613B2

(12) United States Patent
Huang

(10) Patent No.: US 11,364,613 B2
(45) Date of Patent: Jun. 21, 2022

(54) PNEUMATIC TOOL

(71) Applicant: BASSO INDUSTRY CORP., Taichung (TW)

(72) Inventor: Chi-Yung Huang, Taichung (TW)

(73) Assignee: Basso Industry Corp., Taichung (TW)

( * ) Notice: Subject to any disclaimer, the term of this patent is extended or adjusted under 35 U.S.C. 154(b) by 62 days.

(21) Appl. No.: 16/689,527

(22) Filed: Nov. 20, 2019

(65) Prior Publication Data

US 2020/0156233 A1 May 21, 2020

(30) Foreign Application Priority Data

Nov. 21, 2018 (TW) ..... 107215787

(51) Int. Cl.
*B25F 5/00* (2006.01)
*B25B 21/00* (2006.01)

(52) U.S. Cl.
CPC ..... *B25F 5/001* (2013.01); *B25B 21/00* (2013.01)

(58) Field of Classification Search
CPC ..... B25B 21/00; B25B 21/005; B25B 23/145
See application file for complete search history.

(56) References Cited

U.S. PATENT DOCUMENTS 6,883,619 B1 * 4/2005 Huang ..... B25B 21/02 173/168
7,594,549 B2 * 9/2009 Hua ..... B25B 21/00 173/171
8,267,190 B2 * 9/2012 Li ..... B23Q 5/00 173/104
2003/0230423 A1 * 12/2003 Izumisawa ..... B25B 23/145 173/107
2009/0272554 A1 * 11/2009 Young ..... F01D 15/06 173/169
2012/0292066 A1 * 11/2012 Ting ..... B25B 21/02 173/104
2012/0325511 A1 * 12/2012 Cheng ..... B25B 21/00 173/169
2013/0298755 A1 11/2013 Su et al.
(Continued)

FOREIGN PATENT DOCUMENTS

EP 2604387 A2 6/2013
TW M414304 U 10/2011
TW I610771 B 1/2018

OTHER PUBLICATIONS

Search Report issued to European counterpart application No. 19209967.9 by the EPO dated May 15, 2020.

*Primary Examiner* — Anna K Kinsaul
*Assistant Examiner* — Himchan Song
(74) *Attorney, Agent, or Firm* — Burris Law, PLLC

(57) ABSTRACT

A pneumatic tool includes a casing unit, an air motor, a rotary valve, and a turning unit. The rotary valve is mounted to the air motor and is rotatable about a valve axis. The turning unit includes a ring member that surrounds and is rotatably mounted to the casing unit, and that is connected to the rotary valve, such that rotation of the ring member relative to the casing unit drives the rotary valve to rotate about the valve axis relative to the air motor among a first-end position, a second-end position and at least one in-between position for adjusting airflow that travels from an air inlet passage of the casing unit, through an opening and an intermediate passage of the rotary valve, to an air chamber of the air motor.

11 Claims, 15 Drawing Sheets

(56) References Cited

U.S. PATENT DOCUMENTS

| | | | | |
|---|---|---|---|---|
| 2014/0209342 | A1 | 7/2014 | Chen | |
| 2014/0231111 | A1* | 8/2014 | Lehnert | B25F 5/005 173/221 |
| 2015/0075832 | A1 | 3/2015 | Cheng | |
| 2015/0197003 | A1* | 7/2015 | Lin | B23Q 5/06 173/218 |
| 2015/0306746 | A1* | 10/2015 | Chen | F16K 35/04 173/169 |
| 2020/0331137 | A1* | 10/2020 | Huang | B25F 5/001 |

* cited by examiner

PNEUMATIC TOOL

CROSS-REFERENCE TO RELATED APPLICATION

This application claims priority of Taiwanese Patent Application No. 107215787, filed on Nov. 21, 2018.

FIELD

The disclosure relates to a pneumatic tool, and more particularly to a pneumatic tool having an adjustable power output.

BACKGROUND

A conventional pneumatic tool disclosed in Taiwanese Utility Model Patent No. M414304 includes a casing, an air motor, a rotary valve and a switching device.

The air motor is mounted in the casing, and includes a cylinder and a rotor that is rotatably mounted in the cylinder. The cylinder has two inlet air passages. The rotary valve is mounted in the casing, and includes a valve tube for guiding air into the cylinder via one of the inlet air passages. The switching device is arc-shaped and is slidably mounted to the casing for driving the valve tube to rotate. In virtue of the rotation of the valve tube, the valve tube is able to guide the air through either one of the inlet air passages and into the cylinder of the air motor, thereby changing a rotating direction of the rotor.

However, such conventional pneumatic tool can only control the rotating direction of the rotor, that is, the direction of the power output, by allowing the air to travel through either one of the inlet air passages. It is not capable of controlling the flow rate of the air, which means the magnitude of the power output is not adjustable to meet different requirements.

SUMMARY

Therefore, the object of the disclosure is to provide a pneumatic tool that can alleviate the drawback of the prior art.

According to the disclosure, a pneumatic tool includes a casing unit, an air motor, a rotary valve, and a turning unit.

The casing unit has an air inlet passage. The air motor is mounted in the casing unit, and includes a cylinder wall that surrounds a motor axis and that defines an air chamber. The cylinder wall has first and second air ports that are in spatial communication with the air chamber. The rotary valve is mounted to the air motor and is rotatable about a valve axis. The rotary valve has an opening and an intermediate passage that spatially intercommunicates the opening with the air inlet passage of the casing unit.

The turning unit includes a ring member that surrounds and is rotatably mounted to the casing unit. The ring member is connected to the rotary valve, such that rotation of the ring member relative to the casing unit drives the rotary valve to rotate about the valve axis relative to the air motor among a first-end position, a second-end position and at least one in-between position.

When the rotary valve is in the first-end position, the opening is in spatial communication with the first air port and is clear of obstructions.

When the rotary valve is in the second-end position, the opening is in spatial communication with the second air port and is clear of obstructions.

When the rotary valve is in the at least one in-between position, the opening is in spatial communication with one of the first and second air ports and is partially blocked.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
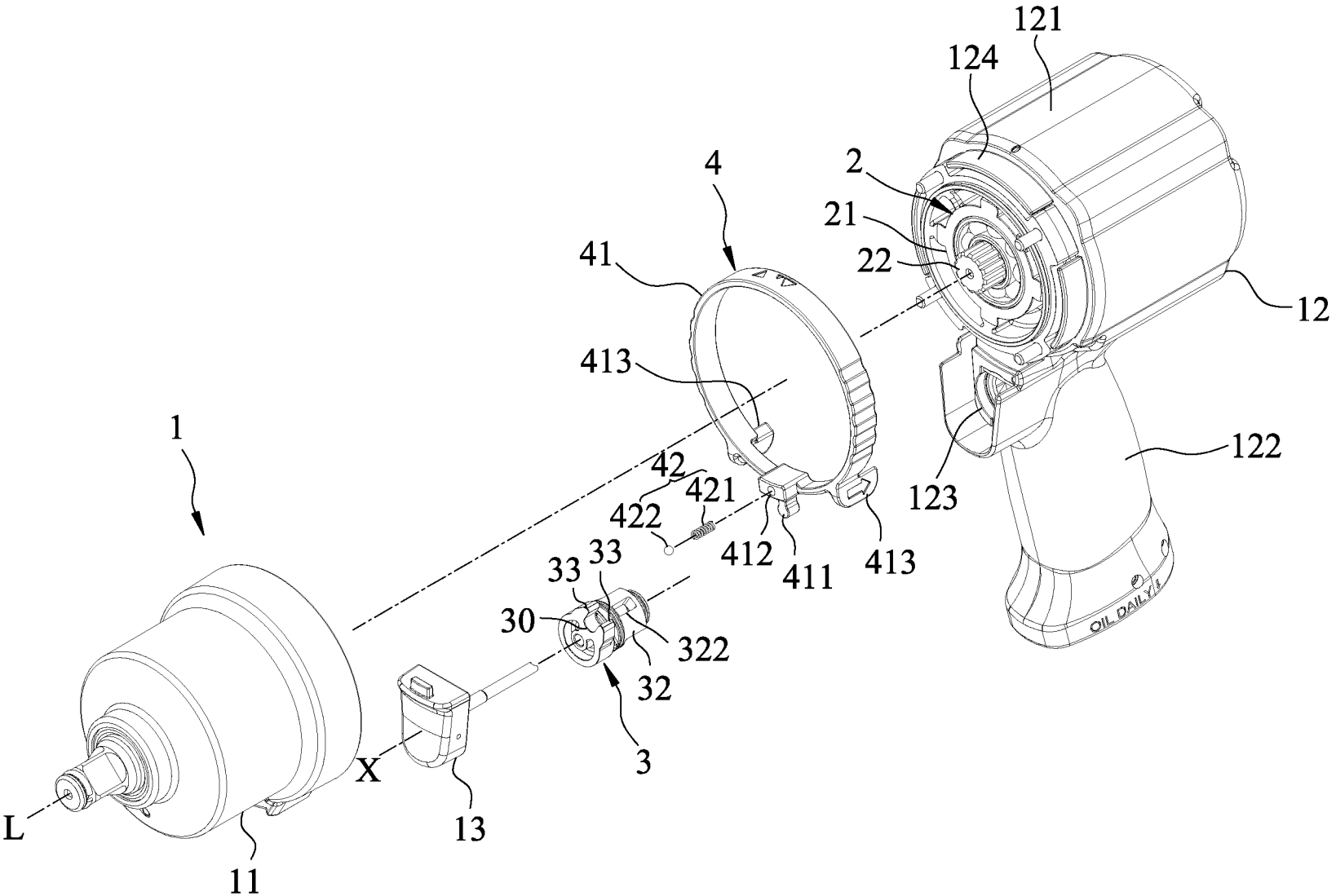
FIG. 1 is a partially exploded perspective view of a first embodiment of a pneumatic tool according to the disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
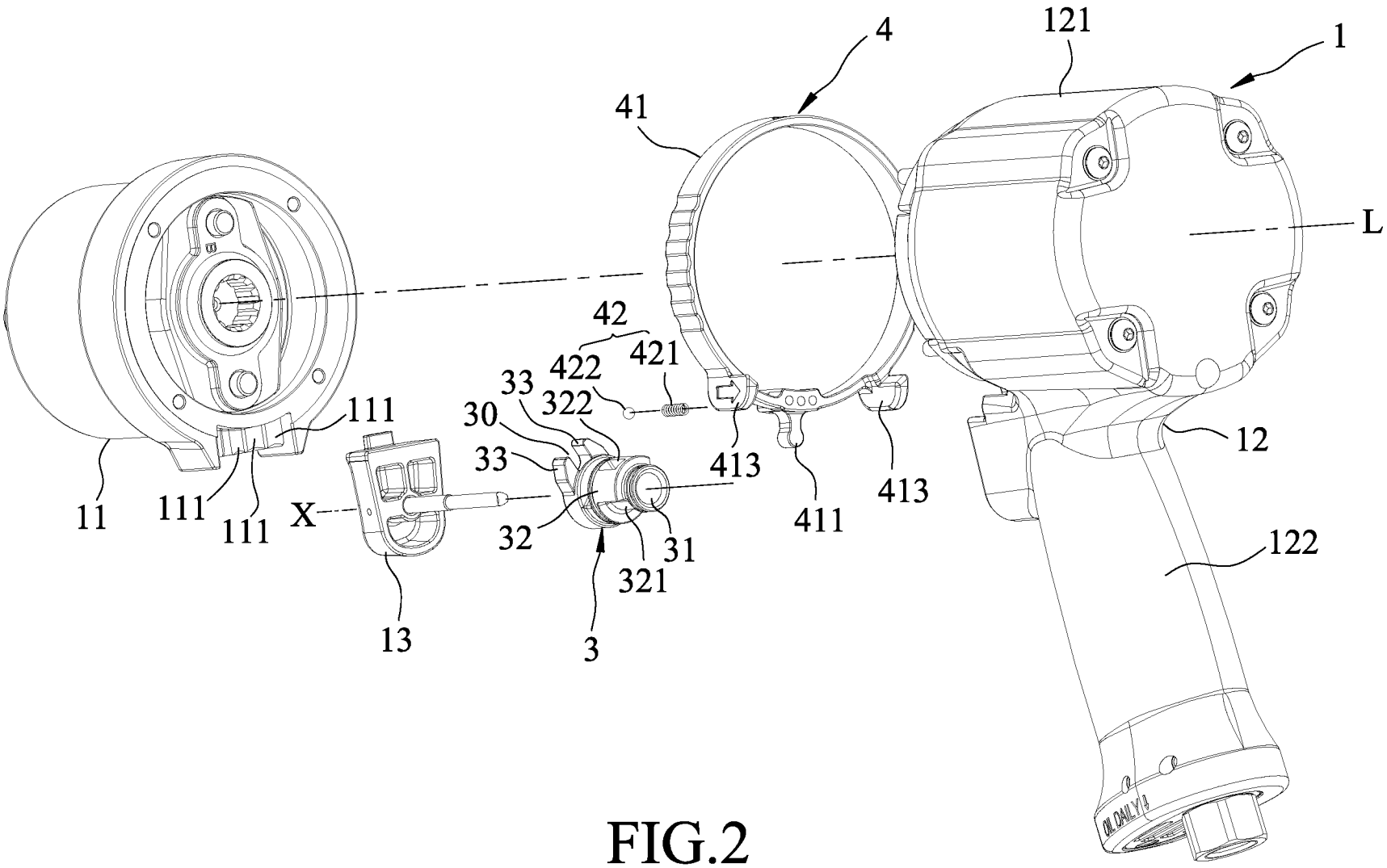
FIG. 2 is another partially exploded perspective view of the first embodiment.
Figure 3:
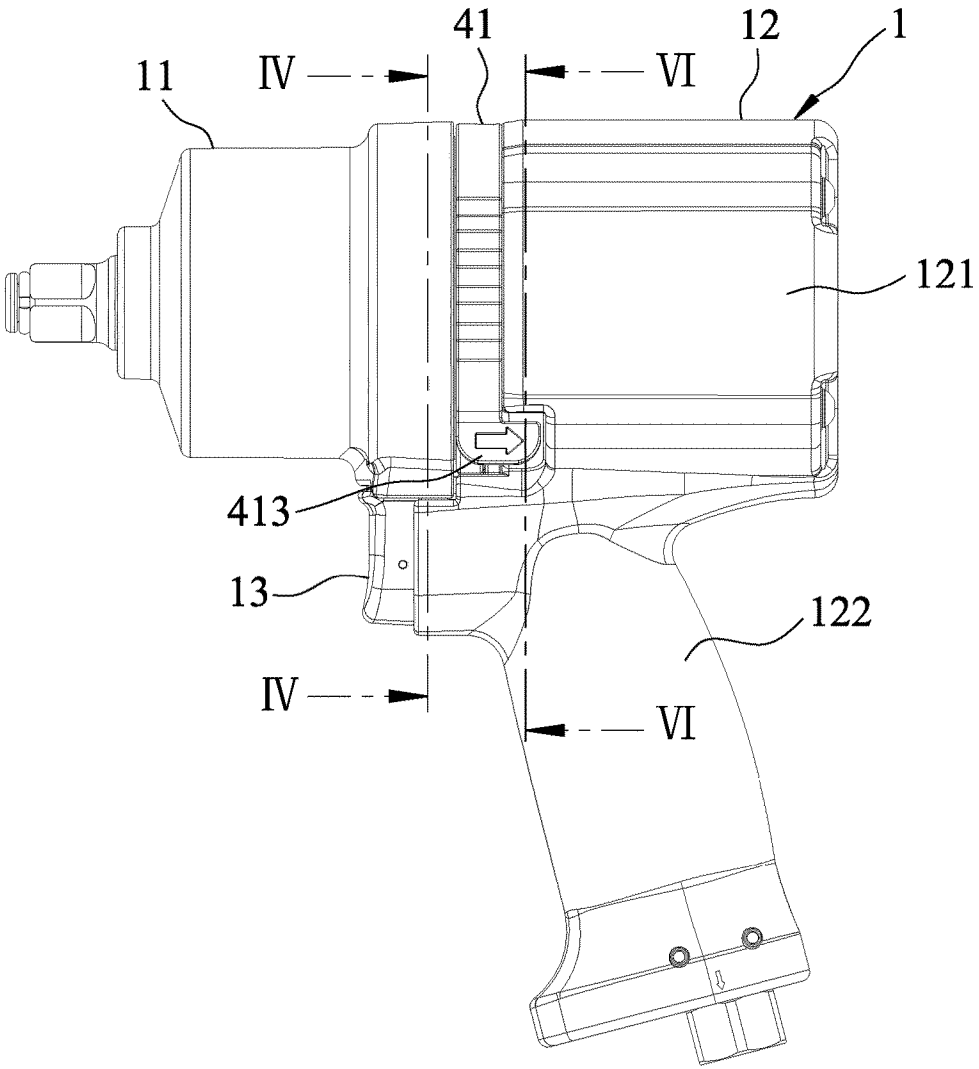
FIG. 3 is a side view of the first embodiment.
Figure 4:
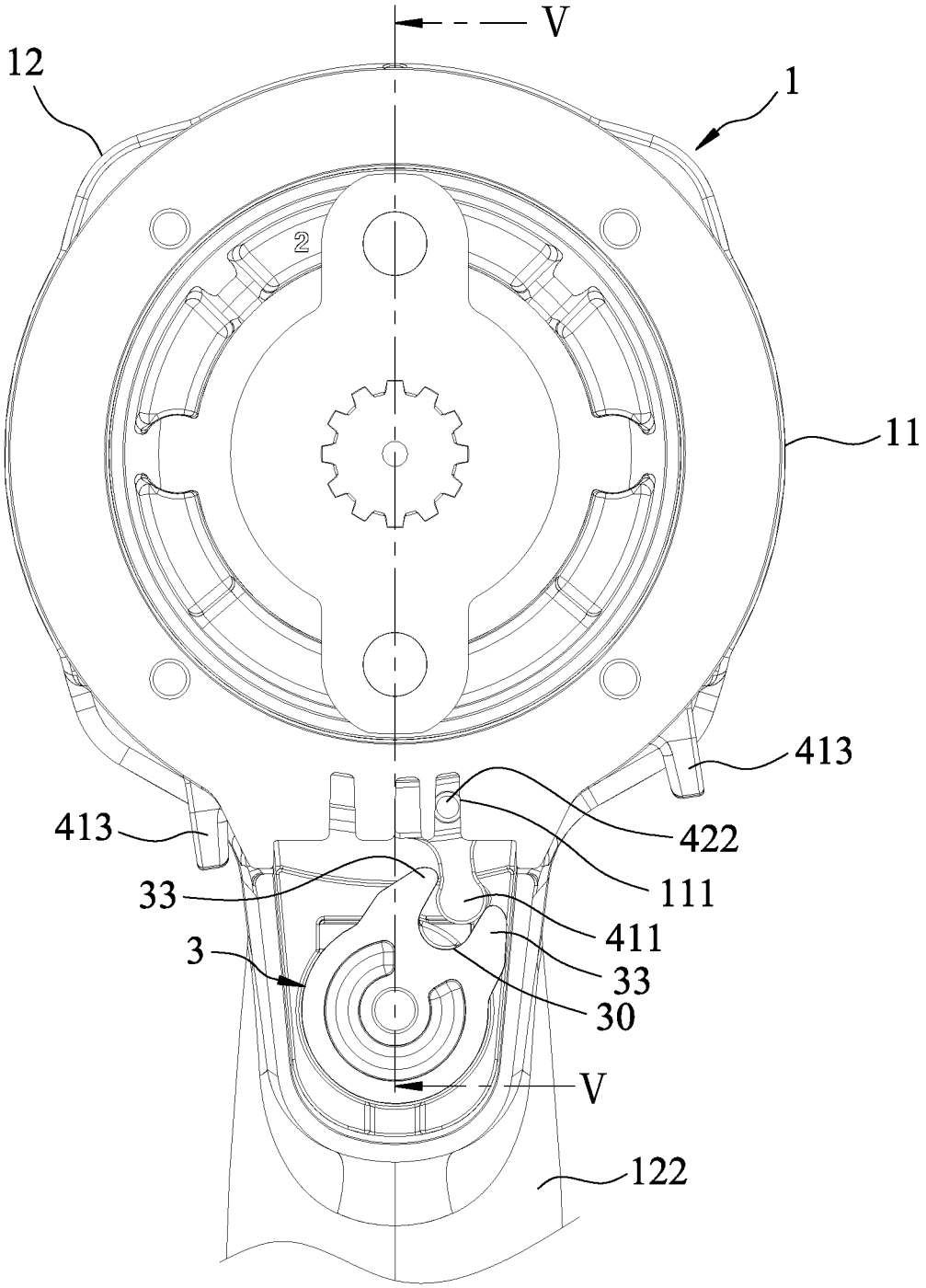
FIG. 4 is a fragmentary sectional view taken along line IV-IV in FIG. 3.
Figure 5:
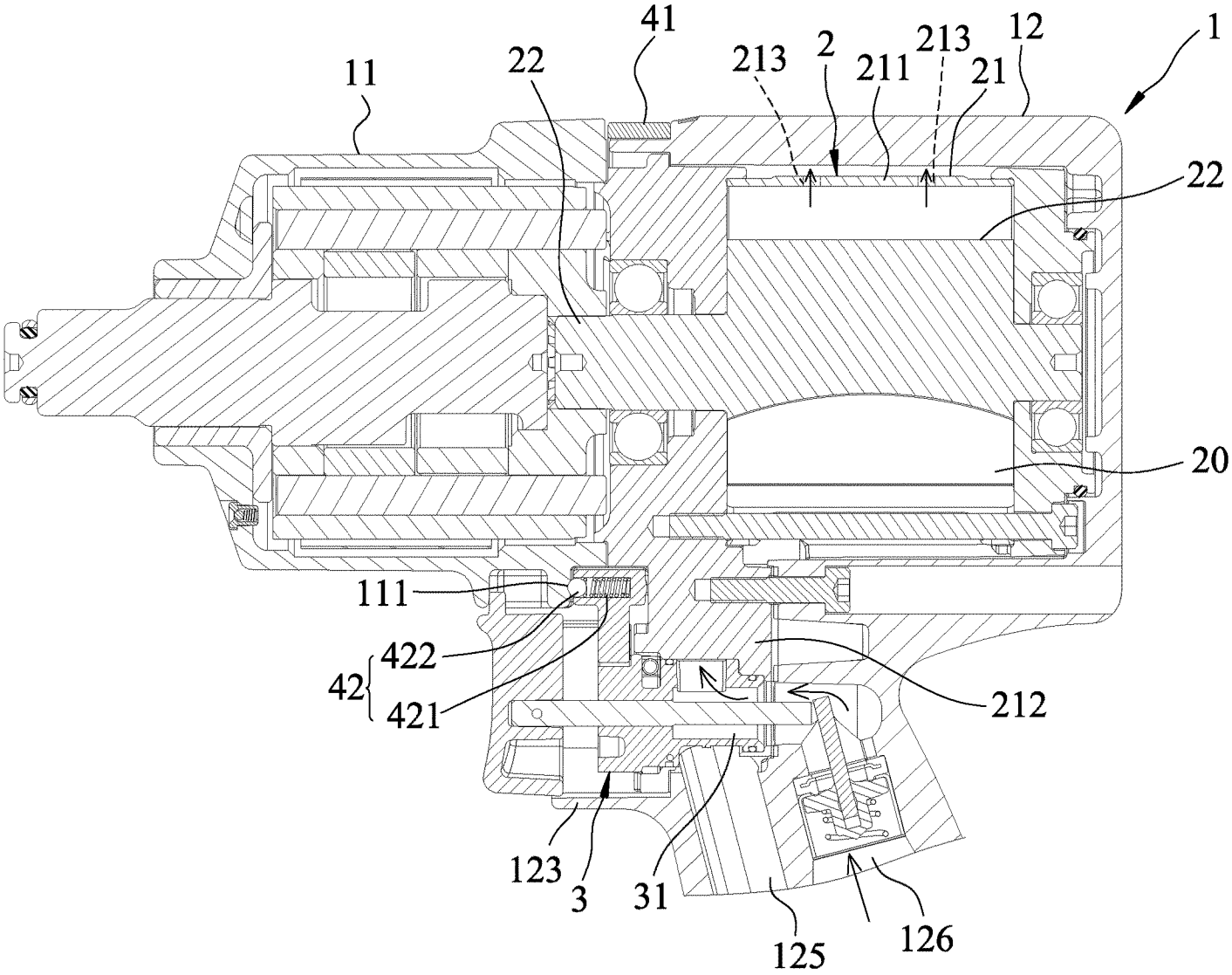
FIG. 5 is a sectional view taken along line V-V in FIG. 4.

Referring to FIGS. 1, 2 and 3, a first embodiment of a pneumatic tool according to the disclosure includes a casing unit 1, an air motor 2, a rotary valve 3, and a turning unit 4.

The casing unit 1 includes a front casing 11, a rear casing 12 coupled to the front casing 11, and a trigger 13. The front and rear casings 11, 12 are arranged along a motor axis (L), and the front casing 11 has three positioning portions 111 that are arranged angularly about the motor axis (L). In the present embodiment, each of the positioning portions 111 is configured as a groove that faces the rear casing 12.

Referring to FIGS. 1, 4, 5 and 6, the rear casing 12 has a rear main casing 121, a handle 122 and a valve seat 123. The rear main casing 121 has a front end portion 124 that is connected to the front casing 11. The handle 122 is connected transversely to the rear main casing 121 and has an air outlet passage 125 that is connected to the external environment, and an air inlet passage 126 that is connected to a source of compressed air. The valve seat 123 is formed between the rear main casing 121 and the handle 122. The trigger 13 is mounted to the casing unit 1, extends through the valve seat 123 into the air inlet passage 126, and is operable to allow compressed air to travel from the air inlet passage 126 into the rear main casing 121. Since operational and technical details of the trigger 13 are known in the prior art and are not the focus of the disclosure, they will not be described further hereinafter.

The air motor 2 is mounted in the rear casing 12, and includes a cylinder wall 21 and a rotor 22. The cylinder wall 21 surrounds the motor axis (L) and defines an air chamber 20. The rotor 22 is mounted in the air chamber 20 and is rotatable about the motor axis (L) relative to the cylinder wall 21.

The cylinder wall 21 has a main body portion 211 that is disposed in the rear main casing 121 of the rear casing 12, and an extending portion 212 that extends from the main body portion 211 into the handle 122 of the rear casing 12. The main body portion 211 is formed with a plurality of discharging holes 213 and first and second air ports 214, 215 that are all in spatial communication with the air chamber 20. The extending portion 212 has first and second air passages 216, 217 that are respectively and directly connected to the first and second air ports 214, 215, and a blocking surface 218 that is formed between the first and second air passages 216, 217.

The rotary valve 3 is disposed in the valve seat 123 of the rear casing 12 of the casing unit 1, is mounted to the extending portion 212 of the cylinder wall 21 of the air motor 2, and is rotatable about a valve axis (X) (see FIGS. 1 and 2) relative to the extending portion 212.

The rotary valve 3 has a surrounding wall 32 and two claw portions 33. The surrounding wall 32 surrounds the valve axis (X), defines an intermediate passage 31, and is formed with a slot 321 and an opening 322. Specifically, the opening 322 extends from the intermediate passage 31, the intermediate passage 31 spatially intercommunicates the opening 322 with the air inlet passage 126 of the casing unit 1, and the slot 321 is spaced apart from the opening 322 and the intermediate passage 31. The slot 321 is in spatial communication with the air outlet passage 125 such that air traveling through the air chamber 20 of the air motor 2 is allowed to be discharged via the slot 321 and the air outlet passage 125. Further details on the air discharging process will be described later. The claw portions 33 protrude outwardly from the surrounding wall 32, and define an engaging notch 30 therebetween.

Referring to FIGS. 6 to 11, in this embodiment, the rotary valve 3 is rotatable among a first-end position (see FIGS. 6 and 7), a second-end position (see FIGS. 8 and 9), and an in-between position (see FIGS. 10 and 11) between the first-end and second-end positions. The first-end and second-end positions are angularly offset from each other about the valve axis (X) by an angle (θ) which ranges from 30 to 120 degrees.

Figure 6:
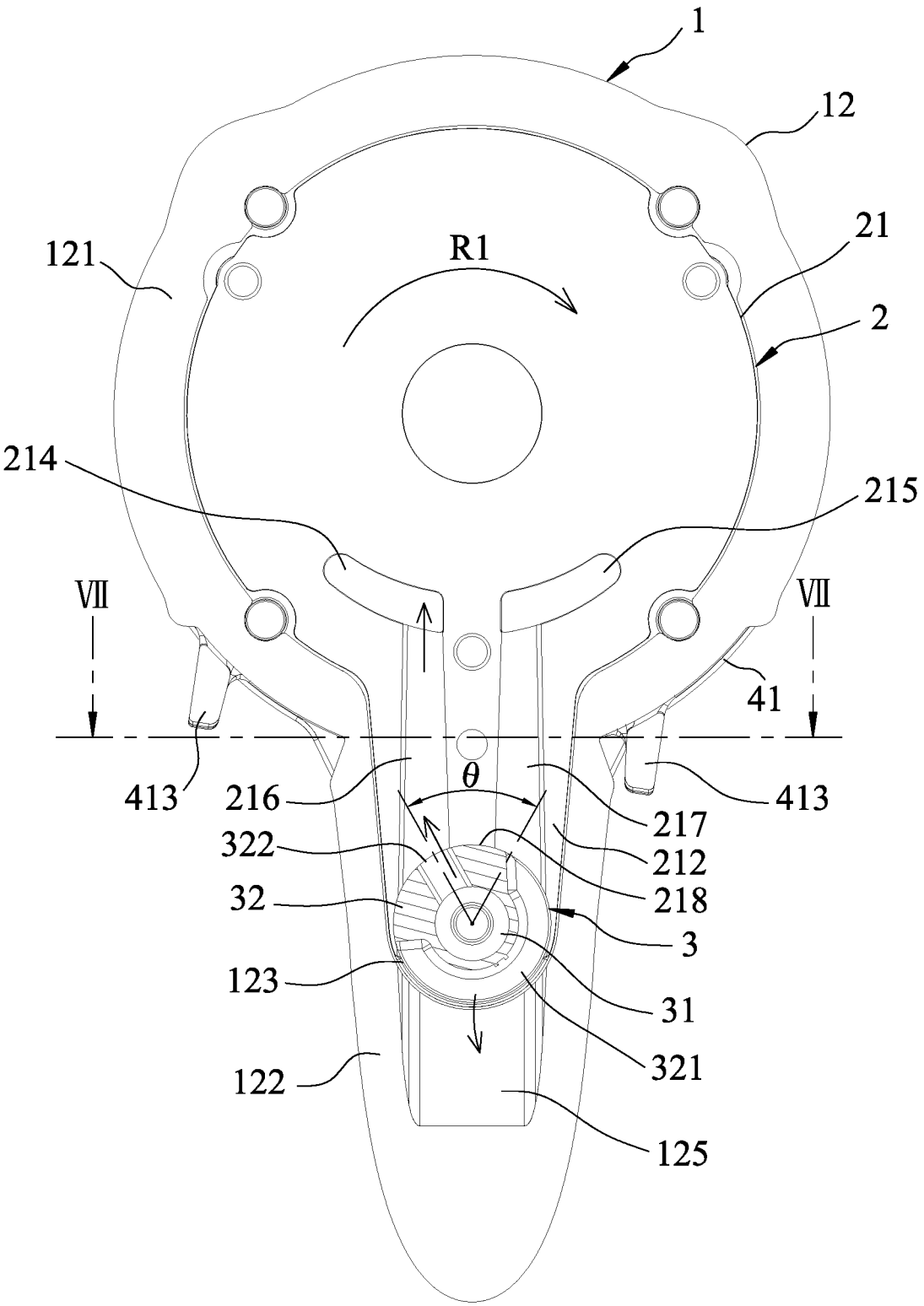
FIG. 6 is a sectional view taken along line VI-VI of FIG. 3, illustrating a rotary valve in a first-end position.
Figure 7:
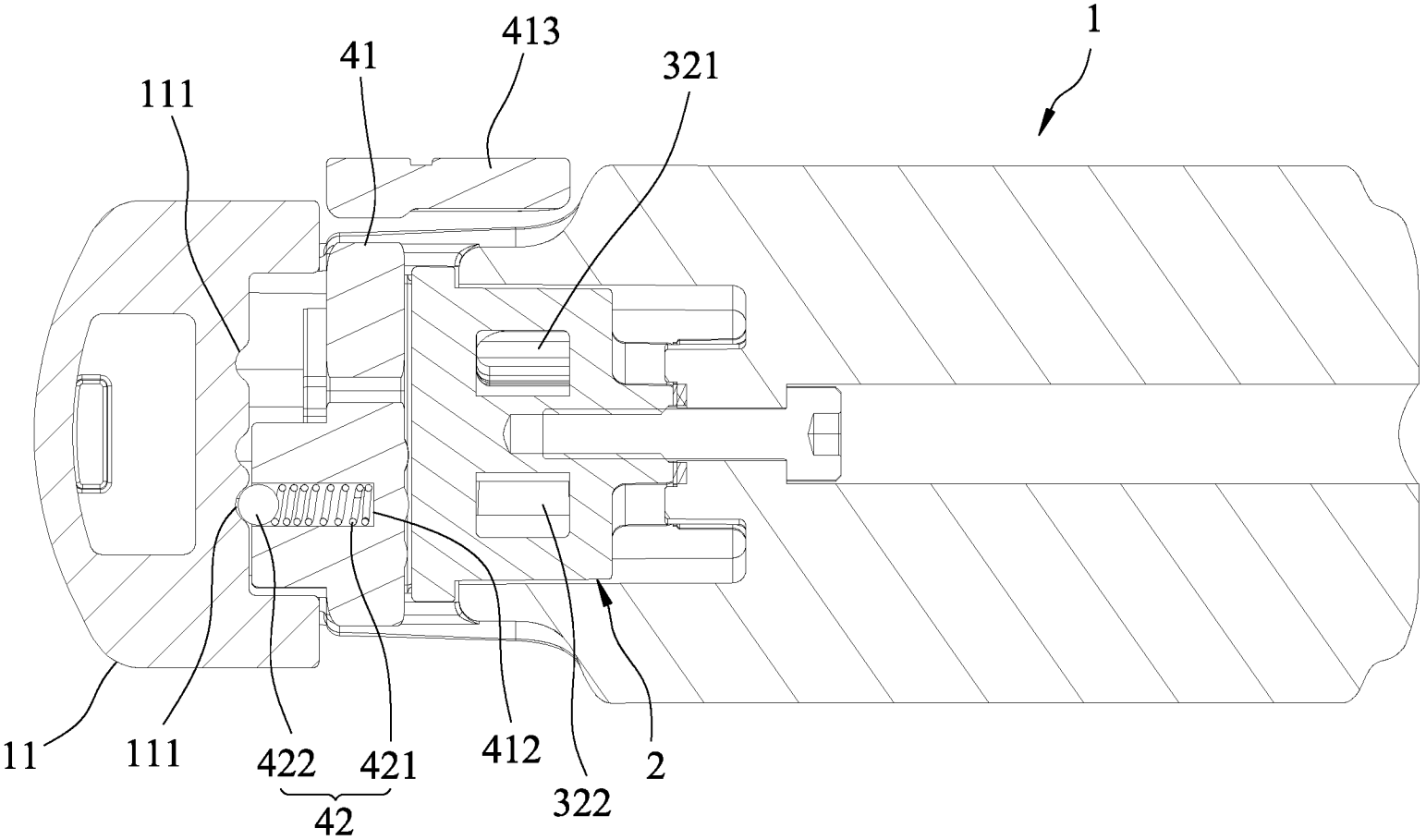
FIG. 7 is a sectional view taken along line VII-VII in FIG. 6, illustrating a positioning subunit being engaged with a corresponding positioning portion when the rotary valve is in the first-end position.

When the rotary valve 3 is in the first-end position as shown in FIGS. 6 and 7, the opening 322 thereof is in spatial communication with the first air passage 216 and the first air port 214 of the air motor 2, and is clear of obstructions, so that the compressed air traveling through the air inlet passage 126 of the casing unit 1, the intermediate passage 31 of the rotary valve 3, and the opening 322 of the rotary valve 3 is allowed to flow through the first air passage 216 and the first air port 214 of the air motor 2, and to flow into the air chamber 20 of the air motor 2 for driving operation of the air motor 2. Specifically, the rotor 22 of the air motor 2 rotates in a first direction (R1) (see FIG. 6) during the operation of the air motor 2.

In addition, since the slot 321 spatially intercommunicates the air outlet passage 125 with the second air passage 217 and the second air port 215 of the air motor 2, the air traveling through the air chamber 20 is allowed to pass through the second air port 215, the second air passage 217, the slot 321 and the air outlet passage 125 to be discharged into the external environment.

Figure 8:
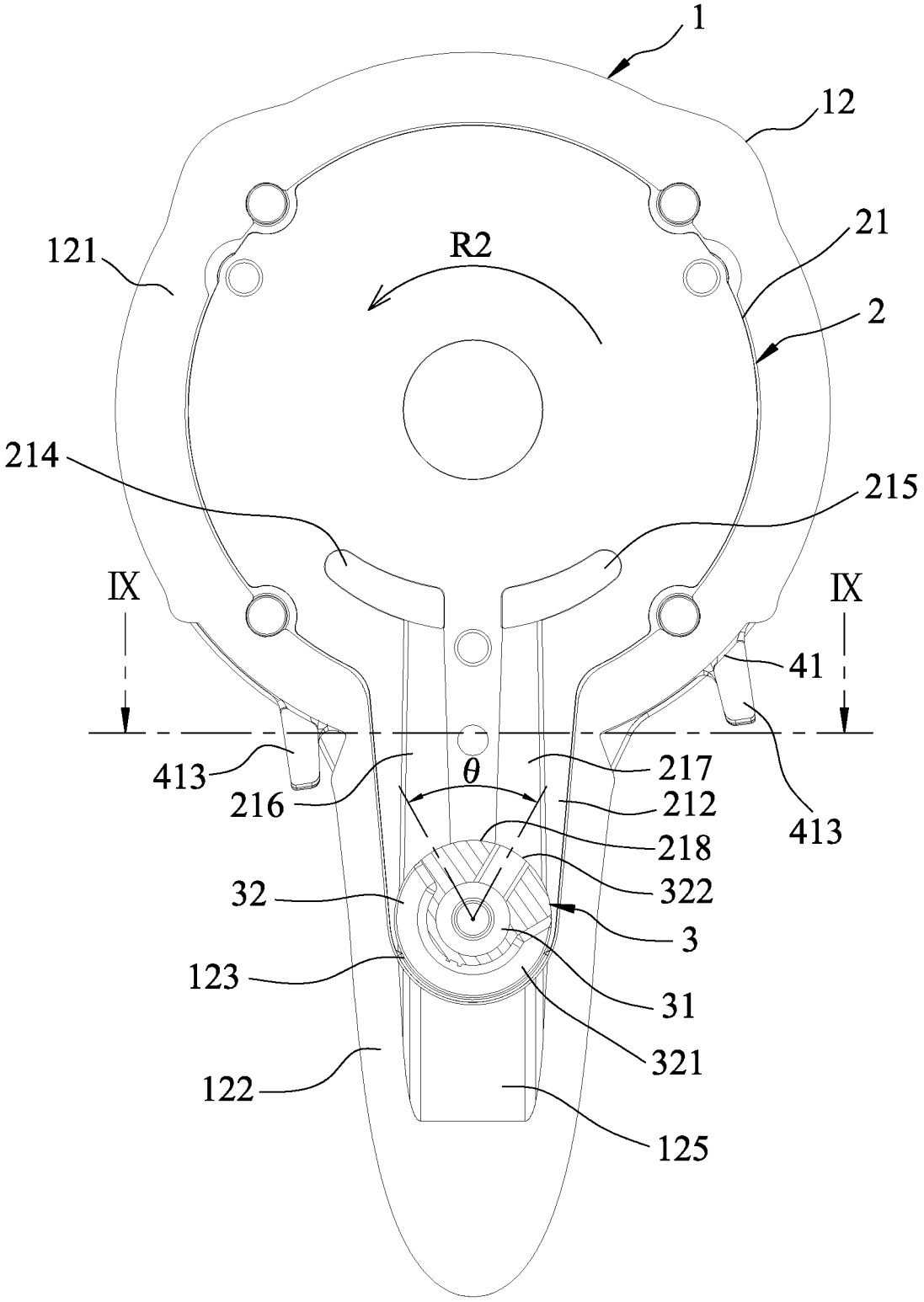
FIG. 8 is a view similar to FIG. 6, but illustrating the rotary valve in a second-end position.
Figure 9:
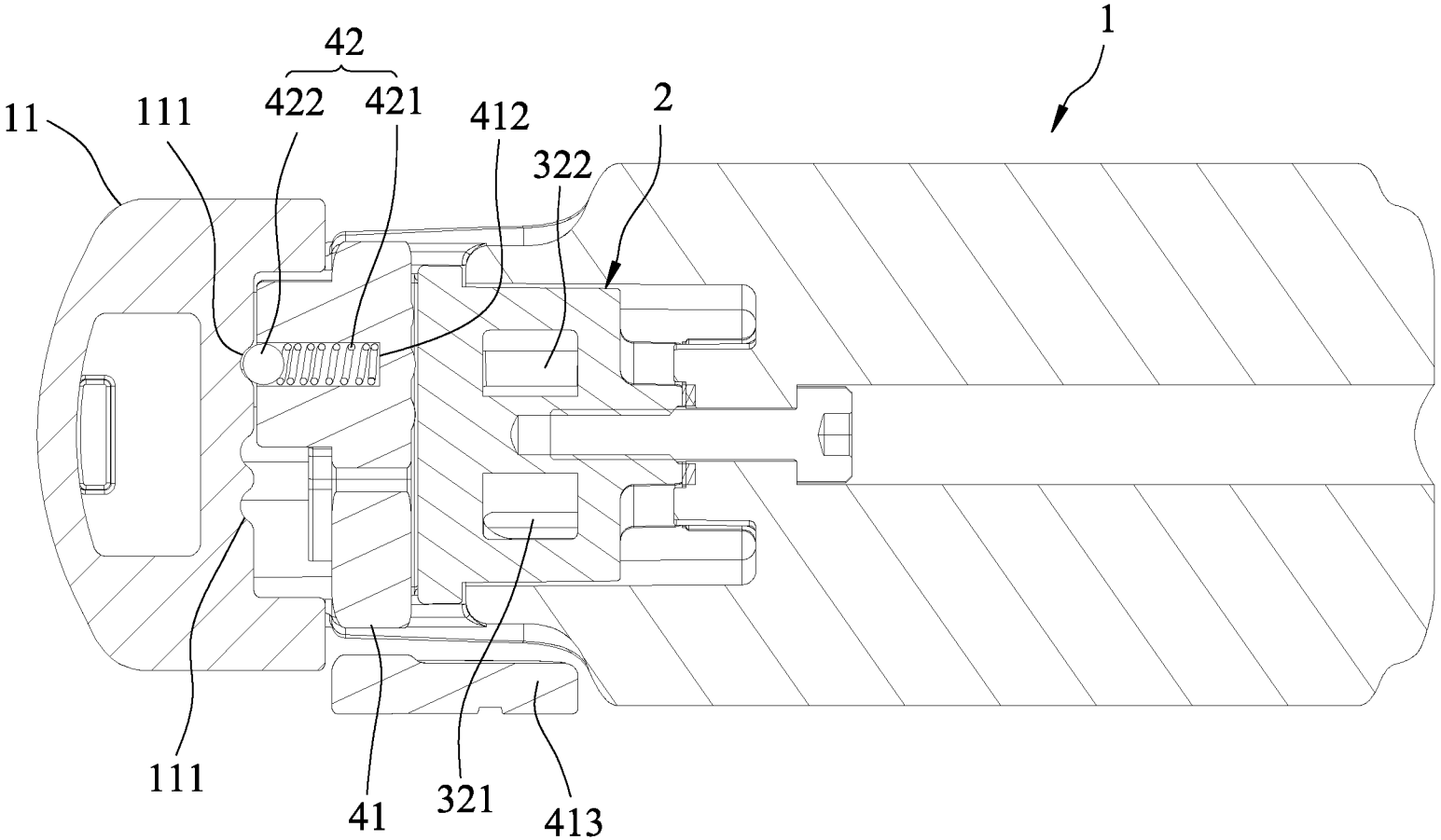
FIG. 9 is a sectional view taken along line IX-IX in FIG. 8, illustrating the positioning subunit being engaged with another corresponding positioning portion when the rotary valve is in the second-end position.

When the rotary valve 3 is in the second-end position as shown in FIGS. 8 and 9, the opening 322 is in spatial communication with the second air passage 217 and the second air port 215 of the air motor 2, and is clear of obstructions, so that the compressed air traveling through the air inlet passage 126 is allowed to drive the operation of the air motor 2 in a similar manner as mentioned above. However, in this case, the compressed air flows into the air chamber 20 via the second air passage 217 and the second air port 215, and the rotor 22 of the air motor rotates in a second direction (R2) (see FIG. 8) that is opposite to the first direction (R1).

In addition, the slot 321 now spatially intercommunicates the air outlet passage 125 with the first air passage 216 and the first air port 214 of the air motor 2, so that the air traveling through the air chamber 20 is allowed to pass through the first air port 214 and the first air passage 216 to be discharged into the external environment in a similar manner as mentioned above.

Figure 10:
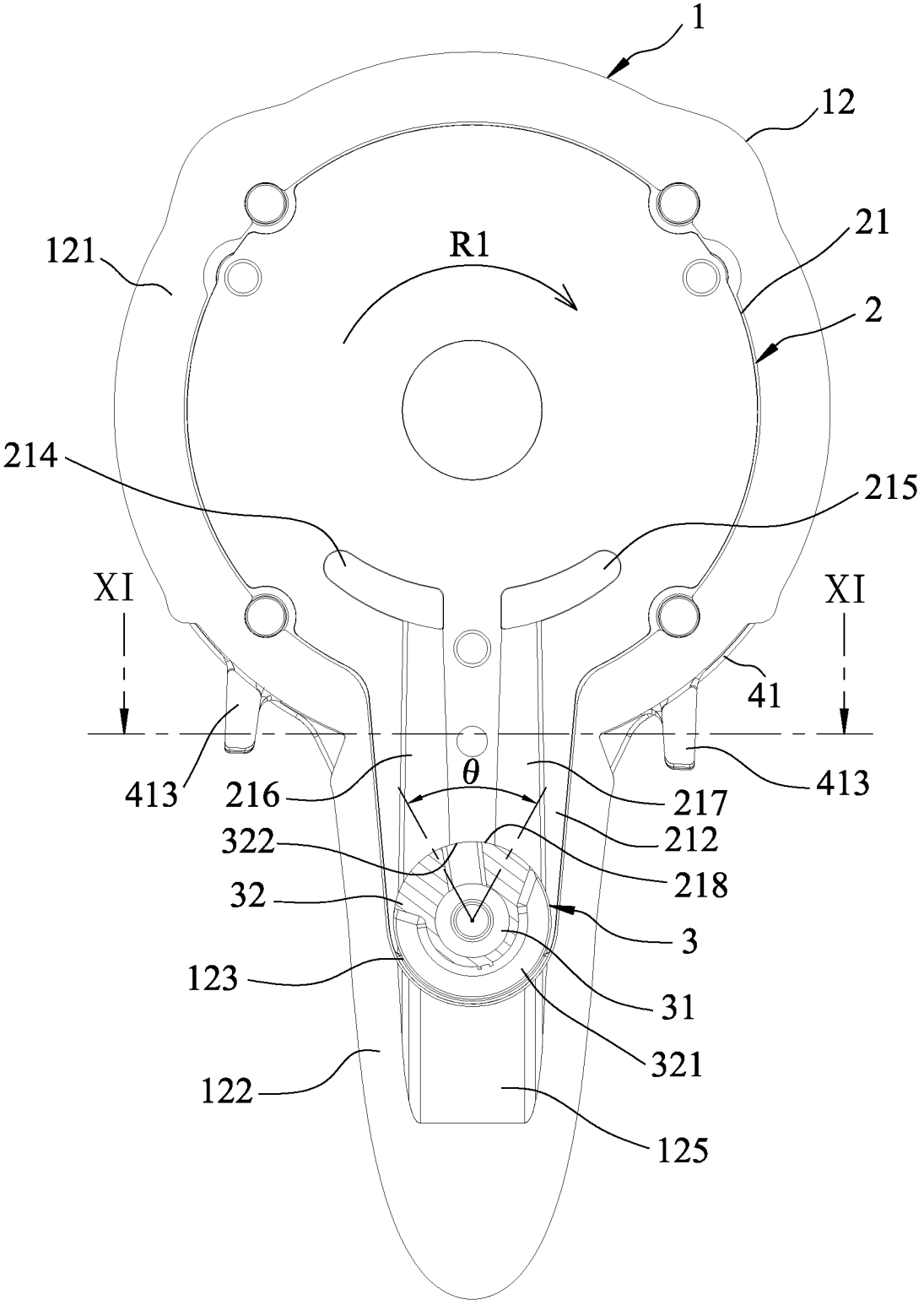
FIG. 10 is another view similar to FIG. 6, but illustrating the rotary valve in an in-between position.
Figure 11:
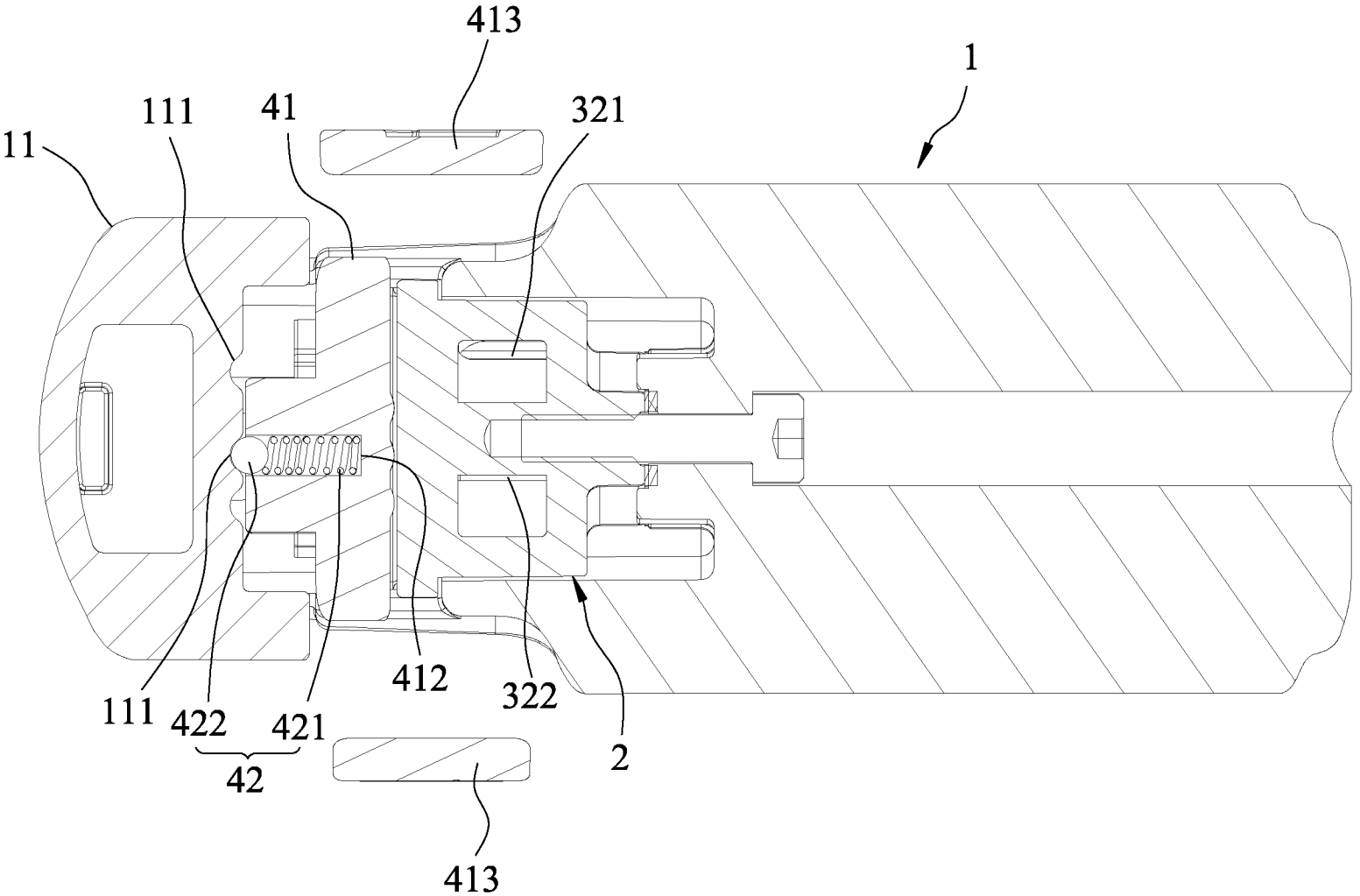
FIG. 11 is a sectional view taken along line XI-XI of FIG. 10, illustrating the positioning subunit being engaged with yet another corresponding positioning portion when the rotary valve is in the in-between position.

When the rotary valve 3 is in the in-between position as shown in FIGS. 10 and 11, the opening 322 is in spatial communication with the first air passage 216 and the first air port 214, and is partially blocked by the blocking surface 218 of the extending portion 212 of the cylinder wall 21. Thus, though the compressed air travels the same route as it does when the rotary valve 3 is in the first-end position, the flow rate of the compressed air is reduced, that is, the air motor 2 is now driven by relatively less compressed air, thereby producing lower power output. Therefore, in cases where lower power output is required, for example, driving a screw into wood, damages resulting from excessive power output can be prevented.

In addition, when the rotary valve 3 is in the in-between position, the air traveling through the air chamber 20 is allowed to be discharged via the slot 321 in the same manner it is discharged when the rotary valve 3 is in the first-end position.

It should be noted that, in other variations of the present embodiment, when the rotary valve 3 is in the in-between position, the intermediate passage 31 thereof is not limited to be connected to the first air port 214, that is, it may be connected to either of the first and second air ports 214, 215. In addition, the number of the in-between position may be two or more in the variations of the embodiment as long as, in each one of such in-between positions, the opening 322 of the rotary valve 3 is connected to a corresponding one of the first and second air ports 214, 215 and is partially blocked by the blocking surface 218.

Referring again to FIGS. 1, 4, 5 and 6, the turning unit 4 includes a ring member 41 and a positioning subunit 42.

The ring member 41 of the turning unit 4 surrounds and is rotatably mounted to the casing unit 1. Specifically, the ring member 41 surrounds the front end portion 124 of the rear casing 12, is disposed between the front and rear casings 11, 12 of the casing unit 1, is connected to the rotary valve 3, and is rotatable relative to the casing unit 1.

In this embodiment, the ring member 41 has an engaging portion 411, a blind hole 412 and two controlling portions 413. The engaging portion 411 movably engages the engaging notch 30 of the rotary valve 3, such that rotation of the ring member 41 relative to the casing unit 1 drives the rotary valve 3 to rotate about the valve axis (X) relative to the air motor 2. The blind hole 412 extends substantially in a direction of the valve axis (X), and has an open end that faces the front casing 11 of the casing unit 1. The controlling portions 413 are angularly spaced apart from each other.

The positioning subunit 42 of the turning unit 4 is mounted to the ring member 41, and includes a ball member 422 and a resilient member 421. The ball member 422 is disposed at the open end of the blind hole 412 of the ring member 41. The resilient member 421 is disposed in the blind hole 412 for biasing the ball member 422 to detachably engage one of the positioning portions 111 of the front casing 11 of the casing unit 1.

It should be noted that, in other variations of the present embodiment, the number of the positioning portion 111 may be four, five or six, etc., depending on the number of the in-between position. In addition, in such variations of the embodiment, the size of an area of the first or second air port 214, 215 blocked by the blocking surface 218 varies among different in-between positions, and the flow rate of the compressed air varies accordingly. In other words, by having more in-between positions, the pneumatic tool is able to provide more options of power output for different uses and purposes.

When using the pneumatic tool of the disclosure, to achieve a maximum power output of the air motor 2 in one of the first and second directions (R1, R2) (see FIGS. 6 and 8), a user is only required to rotate the ring member 41 of the turning unit 4 by pushing a corresponding one of the controlling portions 413 thereof with one hand, such that the rotation of the ring member 41 drives the rotary valve 3 to convert to a corresponding one of the first-end and second-end positions. At the same time, the ball member 422 of the positioning subunit 42 of the turning unit 4 engages a corresponding one of the two outermost positioning portions 111 of the casing unit 1, so that the rotary valve 3 is secured in its current position.

Next, when the user pulls the trigger 13 of the casing unit 1, the compressed air is allowed to enter the air chamber 20 of the air motor 2 by traveling through one of the above-mentioned routes, that is, the air traveling routes when the rotary valve 3 is in the first-end and second-end positions. Once the compressed air enters the air chamber 20, the rotor 22 is driven to rotate in the one of the first and second directions (R1, R2), and the pneumatic tool is ready for use.

To use the pneumatic tool with a relatively lower power output, the user is only required to rotate the ring member 41 with one hand in a similar manner, for driving the rotary valve 3 to the in-between position. At this time, the ball member 422 of the positioning subunit 42 of the turning unit 4 engages the middle one of the positioning portions 111 of the casing unit 1 so that the rotary valve 3 is secured in the in-between position.

Next, when the user pulls the trigger 13 of the casing unit 1, the compressed air is allowed to enter the air chamber 20 of the air motor 2 by traveling through the abovementioned route when the rotary valve 3 is in the in-between position. Once the compressed air enters the air chamber 20, the rotor 22 is driven to rotate in the first direction (R1). During this time, since the first air passage 216 is partially blocked by the blocking surface 218 of the air motor 2, the flow rate of the compressed air is reduced such that the air motor 2 is now driven by relatively less compressed air, thereby producing lower power output.

After the compressed air drives the rotor 22 to rotate, a portion of the air will be discharged out of the air chamber 20 via the discharging holes 213 during the operation of the air motor 2. If the rotor 22 rotates in the first direction (R1), another portion of the air will pass through the second air passage 217 (or if the rotor 22 rotates in the second direction (R2), the another portion of the air will pass through the first air passage 216), and follow the abovementioned air routes to be discharged into the external environment. Further details of the air discharging process is known in the prior art and will be not be described hereinafter.

Figure 12:
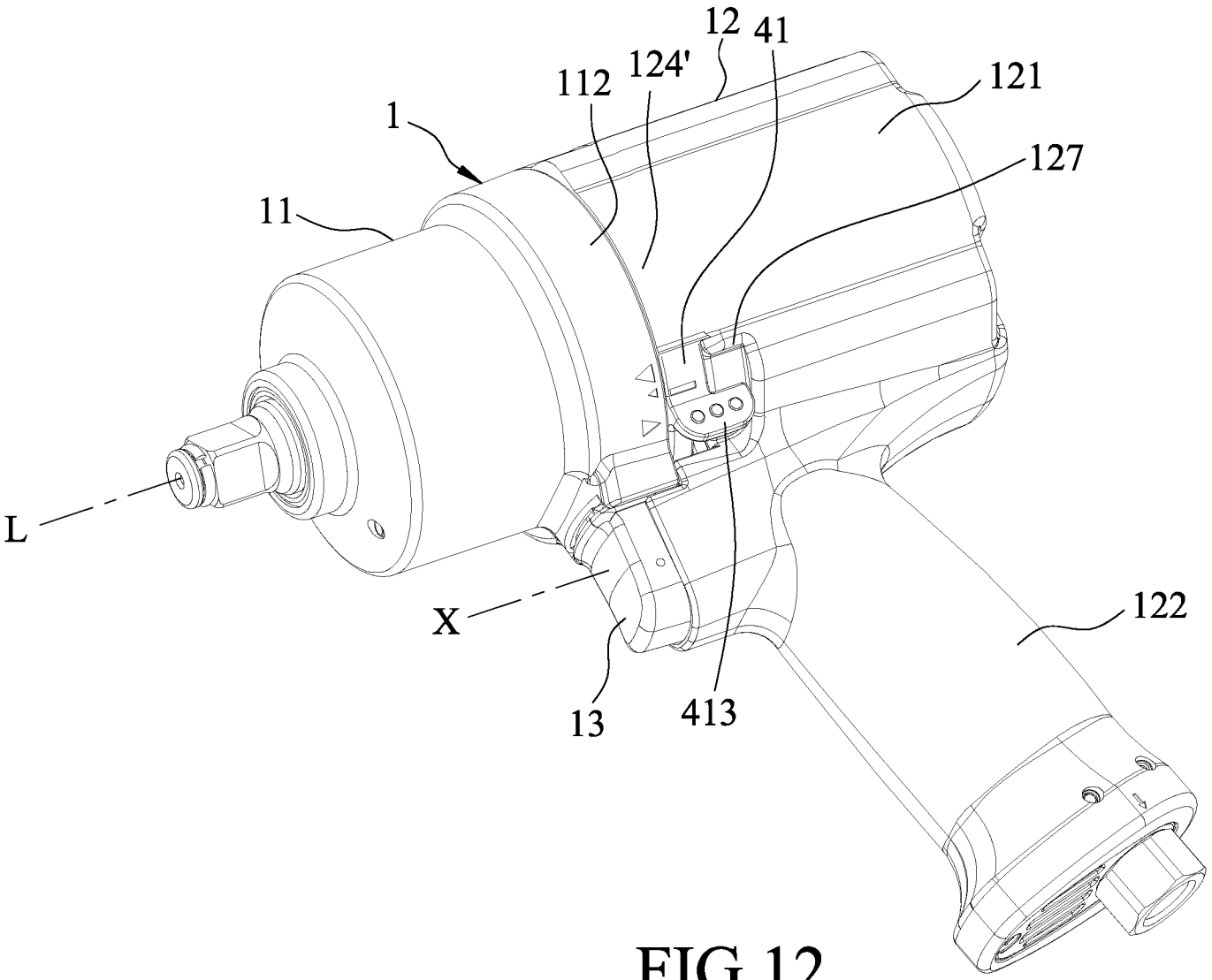
FIG. 12 is a perspective view of a second embodiment of the pneumatic tool according to the disclosure.
Figure 13:
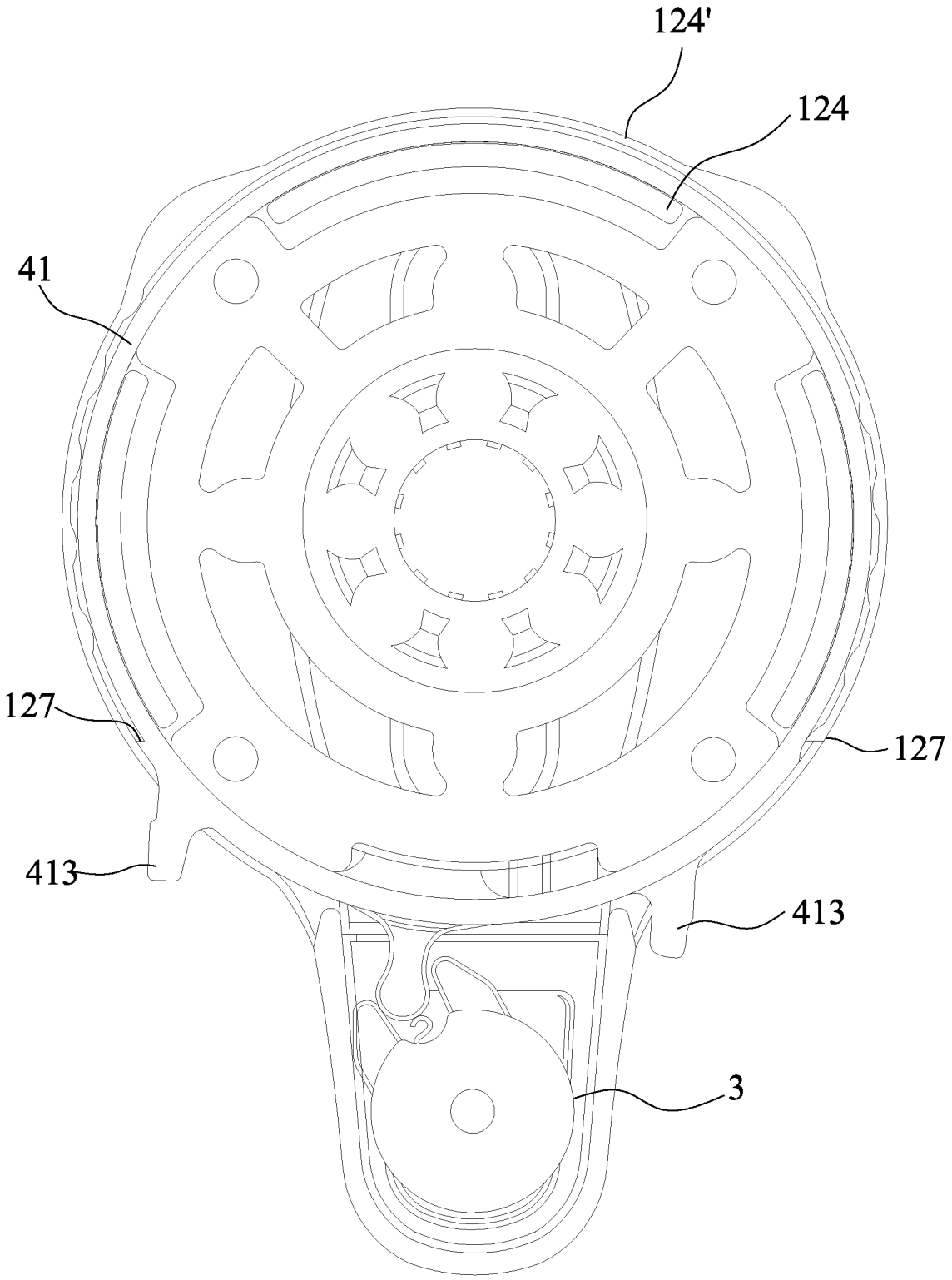
FIG. 13 is a sectional view of the second embodiment, illustrating two controlling portions of a ring member extending respectively and outwardly through two notches.

Referring to FIGS. 12 and 13, a second embodiment of the pneumatic tool according to the disclosure is similar to the first embodiment. The differences between the two embodiments reside in configurations of the casing unit 1 and the turning unit 4.

In the second embodiment, the rear casing 12 of the casing unit 1 further has an outer surrounding portion 124' and two notches 127. A rear end portion 112 of the front casing 11 is connected to the front end portion 124 of the rear casing 12, and the outer surrounding portion 124' surrounds the front end portion 124. The notches 127 are formed in the outer surrounding portion 124' and are angularly spaced apart from each other. The ring member 41 of the turning unit 4 is rotatably clamped between the front end portion 124 and the outer surrounding portion 124', and has two controlling portions 413 that extend outwardly and respectively through the two notches 127.

In a similar manner as mentioned in the previous embodiment, the user is able to drive the rotation of the rotary valve 3 via the ring member 41, thereby adjusting the power output of the pneumatic tool.

Figure 14:
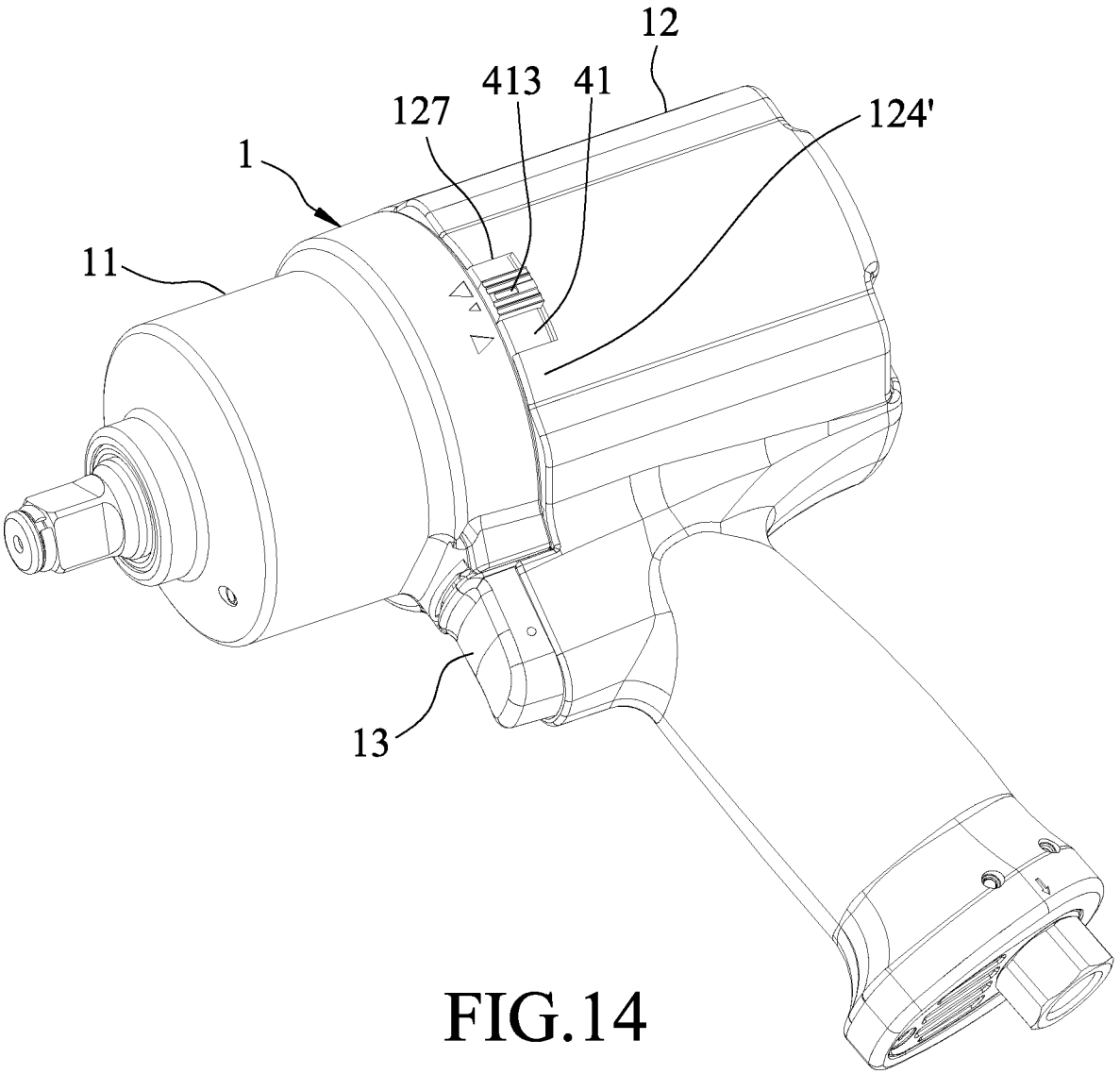
FIG. 14 is a perspective view of a variation of the second embodiment.
Figure 15:
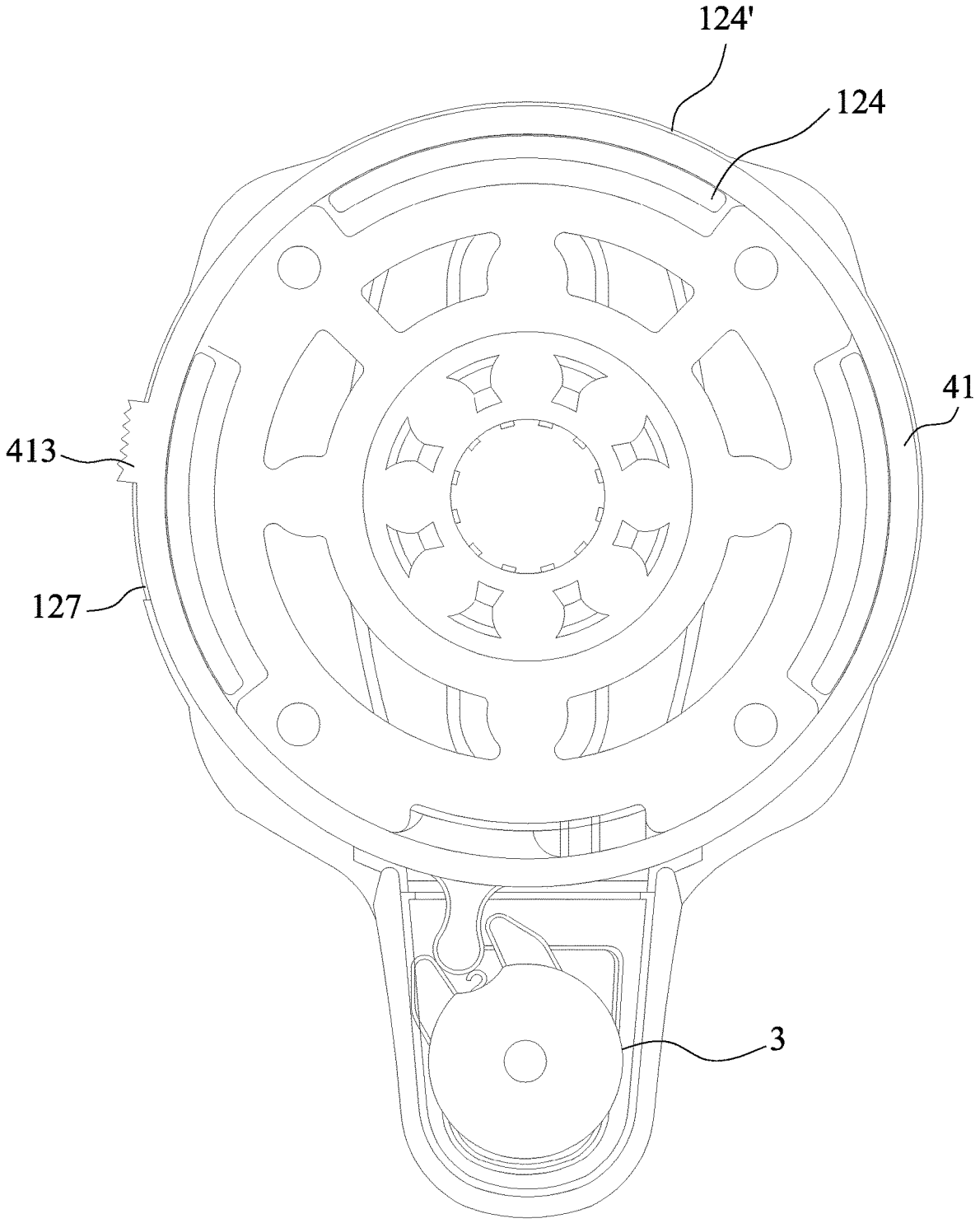
FIG. 15 is a sectional view of the variation of the second embodiment, illustrating one controlling portion of a ring member being exposed from one notch.

However, the number of notch 127 and the number of controlling portion 413 are not limited to two. For example, in a variation of the second embodiment as shown in FIGS. 14 and 15, only one notch 127 is formed in the outer surrounding portion 124' of the rear casing 12, and the ring member 41 has only one controlling portion 413, which is exposed from the notch 127 of the rear casing 12. Again, in a similar manner as mentioned, the user is able to adjust the power output of the pneumatic tool by pushing the controlling portions 413 of the ring member 41.

In summary, the pneumatic tool according to the disclosure has advantages as follows.

By virtue of the blocking surface 218 of the air motor 2, and the engagement between the positioning subunit 42 of the turning unit 4 and any one of the positioning portions 111 of the casing unit 1, the rotary valve 3 is able to convert among different positions, where the compressed air travels in either different routes or different flow rates. Thus, the user is able to adjust not only the direction but the magnitude of the power output of the air motor 2 for different uses and purposes.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pneumatic tool comprising:

a casing unit having an air inlet passage;

an air motor mounted in said casing unit, and including a cylinder wall that surrounds a motor axis and that defines an air chamber, said cylinder wall having first and second air ports that are in spatial communication with said air chamber;

a rotary valve mounted to said air motor and rotatable about a valve axis, said rotary valve having an opening and an intermediate passage that spatially intercommunicates said opening with said air inlet passage of said casing unit, the valve axis (X) being parallel to and spaced apart from the motor axis (L); and a turning unit including a ring member that surrounds and is rotatably mounted to said casing unit, said ring member being connected to said rotary valve, such that rotation of said ring member relative to said casing unit drives said rotary valve to rotate about the valve axis relative to said air motor among a first-end position, where said opening is in spatial communication with said first air port and is clear of obstructions, a second-end position, where said opening is in spatial communication with said second air port and is clear of obstructions, and at least one in-between position, where said opening is in spatial communication with one of said first and second air ports and is partially blocked;

wherein said casing unit includes a front casing and a rear casing that are arranged along the motor axis;

wherein said rear casing further has a front end portion connected to said front casing; and wherein said ring member of said turning unit surrounds said front end portion and is disposed between said front and rear casings of said casing unit.

2. The pneumatic tool as claimed in claim 1, wherein said cylinder wall of said air motor further has first and second air passages that are respectively and directly connected to said first and second air ports, and a blocking surface that is formed between said first and second air passages, said opening of said rotary valve being partially blocked by said blocking surface when said rotary valve is in said at least one in-between position.

3. The pneumatic tool as claimed in claim 2, wherein said casing unit further has a plurality of positioning portions, said turning unit further including a positioning subunit that is mounted to said ring member and that detachably engages one of said positioning portions for positioning said rotary valve at a respective one of the first-end position, the second-end position, and the at least one in-between position.

4. The pneumatic tool as claimed in claim 3, wherein:

each of said positioning portions of said casing unit is configured as a groove;

said ring member has a blind hole having an open end; and said positioning subunit includes a ball member disposed at said open end of said blind hole of said ring member, and a resilient member disposed in said blind hole for biasing said ball member to detachably engage the one of said positioning portions.

5. The pneumatic tool as claimed in claim 3, wherein:

said front casing having said positioning portions that are arranged angularly about the motor axis, said rear casing being coupled to said front casing, and having said air inlet passage, said air motor being mounted in said rear casing; and said cylinder wall of said air motor further has an extending portion that has said first and second air passages and said blocking surface, said rotary valve being mounted to said extending portion of said cylinder wall.

6. The pneumatic tool as claimed in claim 5, wherein said front casing of said casing unit further has a rear end portion, said rear casing of said casing unit further having a front end portion that is connected to said rear end portion of said front casing, an outer surrounding portion that surrounds said front end portion, and at least one notch that is formed in said outer surrounding portion, said ring member of said turning unit being rotatably clamped between said front end and outer surrounding portions and having at least one controlling portion that is exposed from said at least one notch.

7. The pneumatic tool as claimed in claim 6, wherein said at least one controlling portion of said ring member of said turning unit extends outwardly through said at least one notch of said rear casing of said casing unit.

8. The pneumatic tool as claimed in claim 7, wherein said outer surrounding portion of said rear casing of said casing unit is formed with two notches that are angularly spaced apart from each other, said ring member of said turning unit having two controlling portions that are exposed respectively from said notches.

9. The pneumatic tool as claimed in claim 6, wherein said outer surrounding portion of said rear casing of said casing unit is formed with two notches that are angularly spaced apart from each other, said ring member of said turning unit having two controlling portions that are exposed respectively from said notches.

10. The pneumatic tool as claimed in claim 1, wherein:

said rotary valve further has a surrounding wall that surrounds the valve axis, that defines said intermediate passage, and that is formed with said opening, and two claw portions that protrude outwardly from said surrounding wall and that define an engaging notch therebetween; and said ring member of said turning unit further has an engaging portion that movably engages said engaging notch.

11. The pneumatic tool as claimed in claim 10, wherein:

said casing unit further has an air outlet passage; and said surrounding wall of said rotary valve is further formed with a slot that is in spatial communication with said air outlet passage such that air traveling through said air chamber of said air motor is allowed to be discharged through said slot and said air outlet passage.

* * * * *